US007455499B2

(12) United States Patent
Zahuranec

(10) Patent No.: US 7,455,499 B2
(45) Date of Patent: Nov. 25, 2008

(54) CENTRIFUGAL FAN

(75) Inventor: Terry L. Zahuranec, North Olmsted, OH (US)

(73) Assignee: The Scott Fetzer Company, Westlake, OH (US)

( * ) Notice: Subject to any disclaimer, the term of this patent is extended or adjusted under 35 U.S.C. 154(b) by 533 days.

(21) Appl. No.: 11/176,458

(22) Filed: Jul. 7, 2005

(65) Prior Publication Data

US 2007/0009354 A1 Jan. 11, 2007

(51) Int. Cl.
*F04D 29/42* (2006.01)

(52) U.S. Cl. ..... 415/206; 415/211.2; 415/224.5

(58) Field of Classification Search ..... 415/204, 415/206, 207, 211.2, 224.5
See application file for complete search history.

(56) References Cited

U.S. PATENT DOCUMENTS

| | | | | |
|---|---|---|---|---|
| 4,065,233 | A | 12/1977 | Torigoe et al. | |
| 4,120,616 | A | 10/1978 | Dwyer et al. | |
| 5,046,922 | A | 9/1991 | Nakamura et al. | |
| 5,474,422 | A | 12/1995 | Sullivan | |
| 5,511,939 | A | 4/1996 | Tokunaga et al. | |
| 5,573,369 | A | 11/1996 | Du | |
| 5,588,178 | A | 12/1996 | Liu | |
| 6,036,455 | A | 3/2000 | Ciccarelli | |
| 6,301,744 | B1 | 10/2001 | Embree et al. | |
| 6,348,106 | B1 | 2/2002 | Embree et al. | |
| 6,375,720 | B2 | 4/2002 | Embree et al. | |
| 6,579,060 | B1 * | 6/2003 | Mann et al. | 415/119 |
| 2001/0054355 | A1 | 12/2001 | Embree et al. | |
| 2002/0138941 | A1 | 10/2002 | Paterson et al. | |
| 2004/0109760 | A1 | 6/2004 | Jones | |

* cited by examiner

*Primary Examiner*—Ninh H Nguyen
(74) *Attorney, Agent, or Firm*—Jones Day

(57) ABSTRACT

A fan includes a fan housing located on an axis. The apparatus has axially front and rear sections that together define a chamber. Air can enter the chamber through an inlet in the front section. An impeller in the chamber is configured to rotate about the axis to drive the air radially outward. A trough-shaped channel in the rear section extends circumferentially about the axis from a first end of the channel to a second end of the channel. The channel is configured to channel the air away from the first end circumferentially toward the second end. The axially extending depth of the channel increases from the first end toward the second end such that, over a 90° range, an increase in the depth is more than twice an increase in the radially extending width of the channel.

17 Claims, 8 Drawing Sheets

CENTRIFUGAL FAN

TECHNICAL FIELD

This application relates to a centrifugal fan.

BACKGROUND

A centrifugal fan includes a fan housing defining an inlet and an outlet. An impeller within the housing rotates to draw air into the housing through the inlet and to exhaust the air out of the housing through the outlet.

SUMMARY

A fan includes a fan housing located on an axis. The apparatus has axially front and rear sections that together define a chamber. Air can enter the chamber through an inlet in the front section. An impeller in the chamber is configured to rotate about the axis to drive the air radially outward. A trough-shaped channel in the rear section extends circumferentially about the axis from a first end of the channel to a second end of the channel. The channel is configured to channel the air away from the first end circumferentially toward the second end. The axially extending depth of the channel increases from the first end toward the second end such that, over a 90° range, an increase in the depth is more than twice an increase in the radially extending width of the channel.

Preferably, the channel width increases over the 90° range. The range extends from a first location in the channel, 90° from the first end, to a second location in the channel, 180° from first end. At a location in the channel diametrically opposite the first end, the channel depth is greater than the channel width. At the location diametrically opposite the first end, a surface of the rear housing section, bordering the channel, extends linearly rearward along a distance of more than 65% of the channel depth. The channel depth increases approximately linearly with circumferential distance over the 90° range. The channel width increases by less than 30% over the 90° range.

DESCRIPTION

Figure 1:
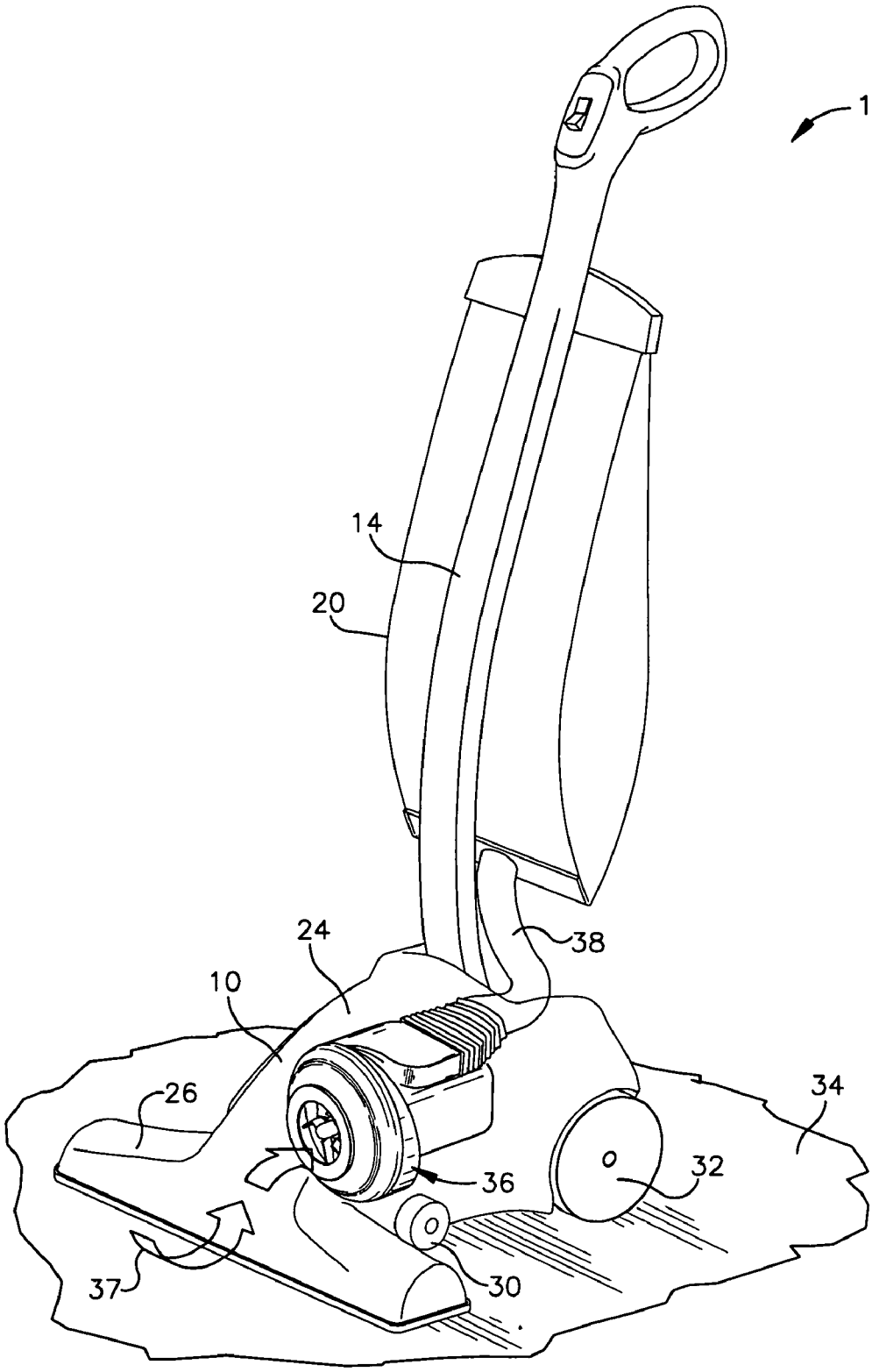
FIG. 1 is a perspective view of a vacuum cleaner including a fan.

The apparatus 1 shown in FIG. 1 has parts that are examples of the elements recited in the claims. The apparatus 1 thus includes examples of how a person of ordinary skill in the art can make and use the claimed invention. It is described here to meet the requirements of enablement and best mode without imposing limitations that are not recited in the claims.

The apparatus 1 is a vacuum cleaner. It includes a base 10, a handle 14 extending upward from the base 10, and a filter bag 20 suspended from the handle 14. The base 10 includes a base housing 24 defining a nozzle 26. Front and rear wheels 30 and 32 are rotatably connected to the housing 24 to enable wheeling the base 10 over a floor 34. A fan 36 in the housing 24 drives a flow 37 of air from the floor 34, through the nozzle 26, the fan 36 and a fill tube 38, into the bag 20. The air flow 37 cleans the floor 34 by carrying dirt from the floor 34 into the bag 20.

Figure 2:
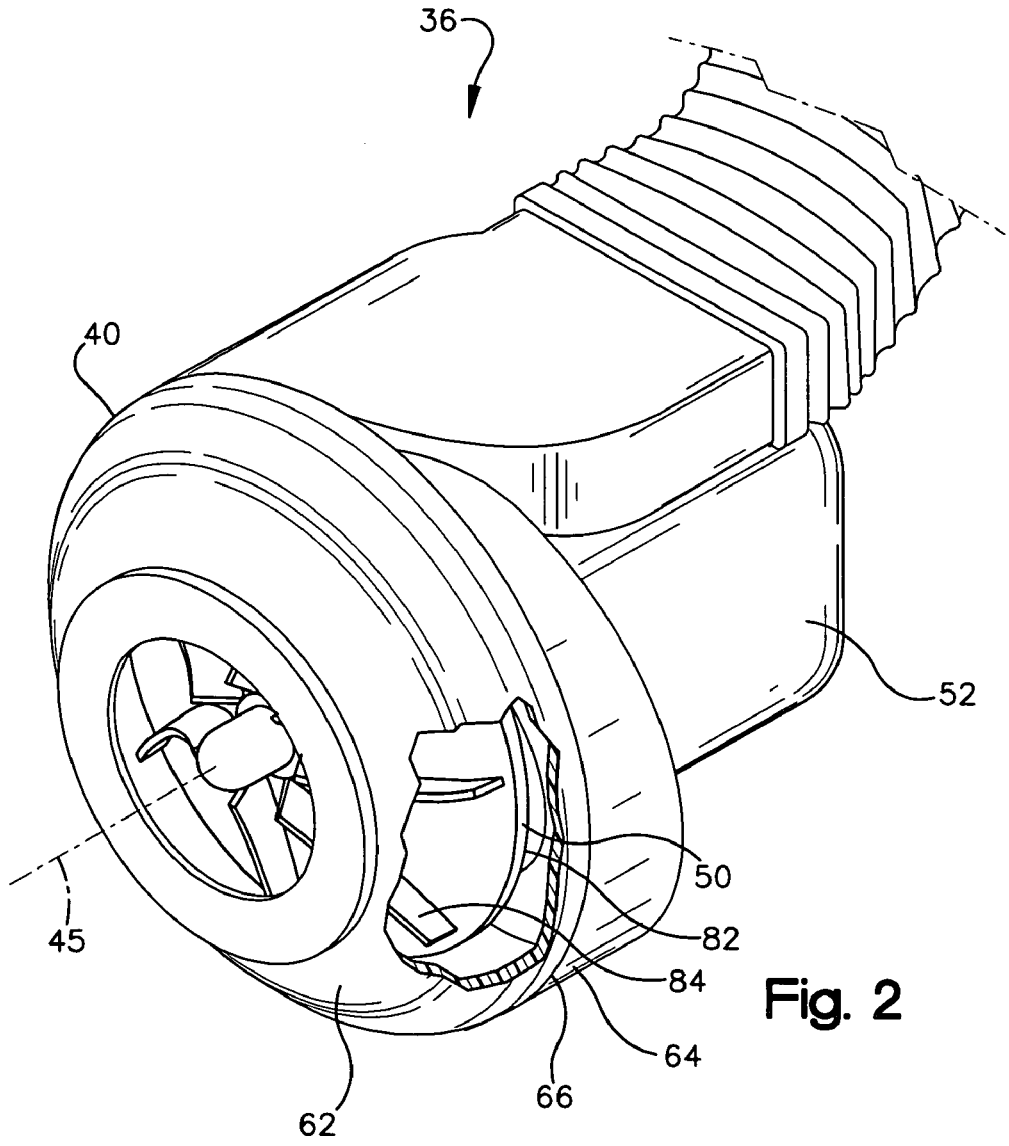
FIG. 2 is a perspective view of the fan.
Figure 3:
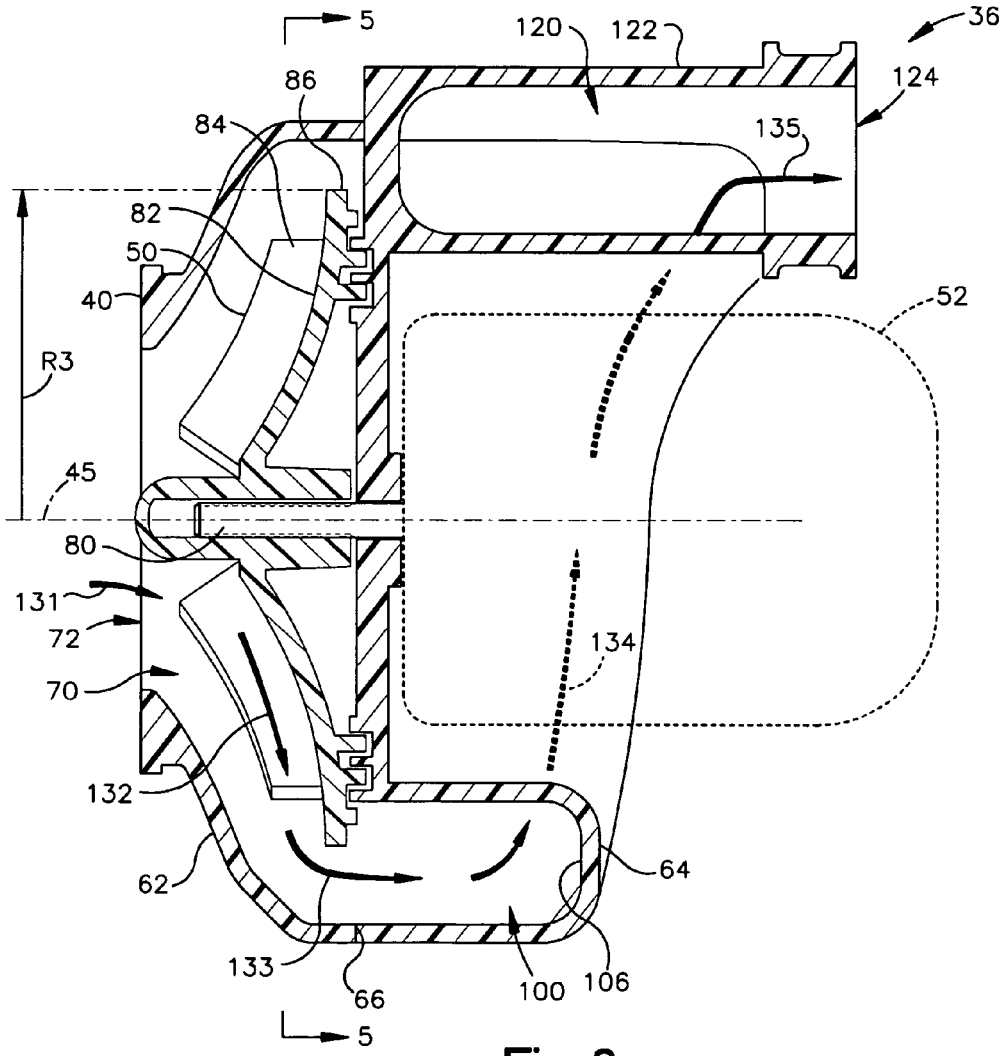
FIG. 3 is a side sectional view of the fan.

As shown in FIG. 2, the fan 36 includes a fan housing 40 located on an axis 45, an impeller 50 and a motor 52. As shown in FIG. 3, the housing 40 has axially front and rear sections 62 and 64. In this example, the sections 62 and 64 are separate parts that meet at a parting line 66. They can alternatively comprise a one-piece structure. The sections 62 and 64 together define a fan chamber 70. Air can enter the chamber 70 through an inlet opening 72 in the front housing section 62.

The impeller 50 is located in the chamber 70, behind the inlet 72. It is affixed to an output shaft 80 of the motor 52 and centered on the axis 45. The impeller 50 has a backplate 82 extending radially outward from the shaft 80 and blades 84 projecting forward from the backplate 82. A radially outer periphery 86 of the backplate 82 is centered on the axis 45.

Figure 4:
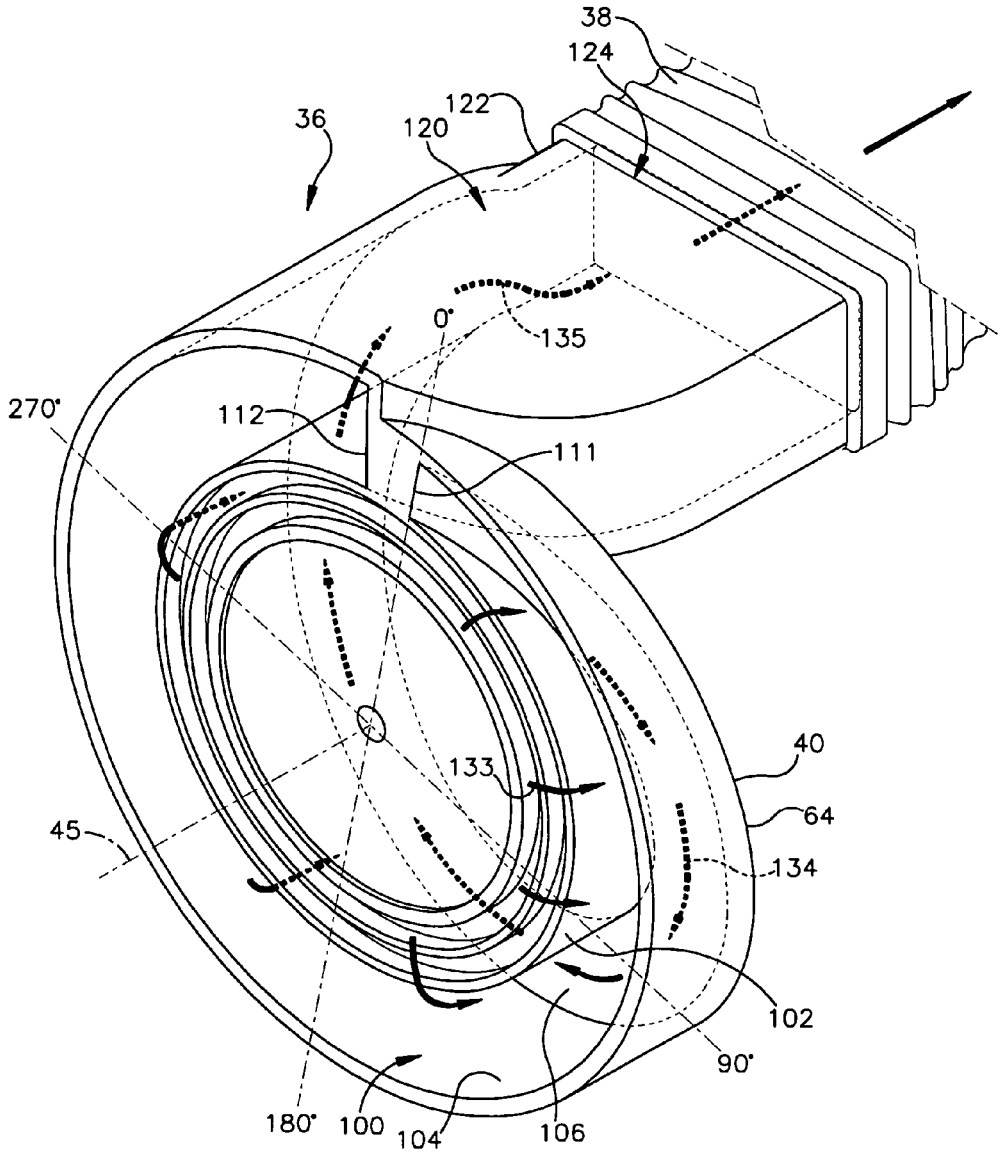
FIG. 4 is a perspective view of a rear section of a housing of the fan.

As shown in FIG. 4, an arcuate trough 100 in the rear housing section 64, behind the impeller 50, defines an air collection channel. The trough-shaped channel 100 is defined and bounded by radially inner and outer surfaces 102 and 104 and a rear surface 106, which are surfaces of the rear housing section 64. These surfaces 102, 104 and 106, along with the channel 100 itself, extend circumferentially about the axis 45 from a first end 111 of the channel 100 to a second end 112 of the channel 100.

The collection channel 100 is connected at its second end 112 to an outlet channel 120 defined by an outlet tube 122. The outlet channel 120 extends directly rearward from the second end 112 of the collection channel 100 to an outlet opening 124 of the outlet tube 122. The outlet tube 122 is part of the fan housing 40 and rigidly fixed with respect to the front and rear housing sections 62 and 64 (FIG. 3).

Operation of the fan 36 is illustrated in FIG. 3. The motor 52 rotates the impeller 50. The impeller 50 drives air rearward through the inlet 72 (arrow 131), radially outward in front of the backplate 82 (arrow 132), and along the front housing section 62 rearwardly past the backplate 82 (arrow 133) and into the collection channel 100. As shown in FIG. 4, the air follows a circumferential path (arrow 134) through the collection channel 100 to the outlet channel 120. The outlet channel 120 redirects (arrow 135) the air from a circumferential path to a rearwardly axial path. The air flows through the outlet tube 122 and the fill tube 38 into the filter bag 20 (FIG. 1).

Figure 5:
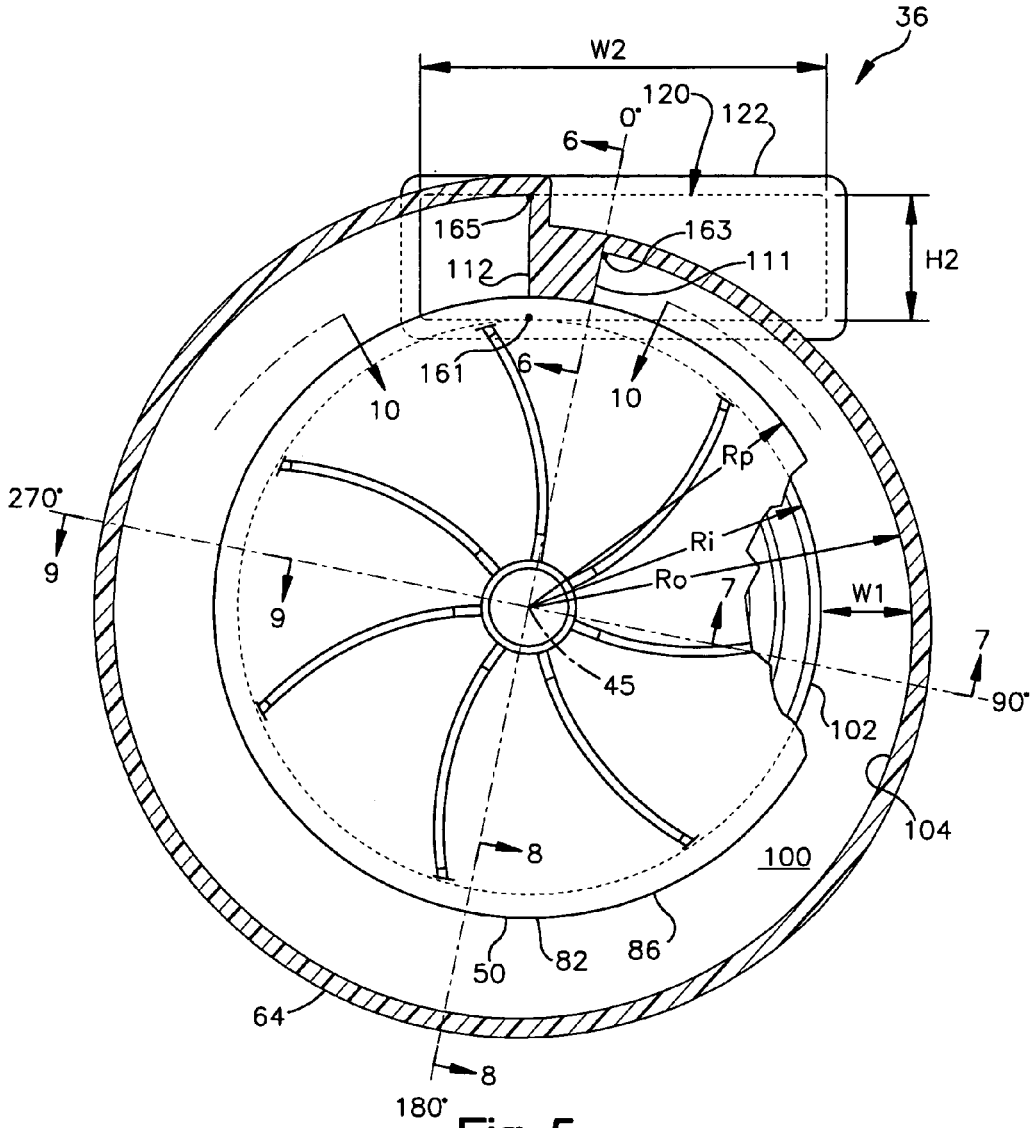
FIG. 5 is a view taken at line 5-5 of FIG. 3.
Figure 6:
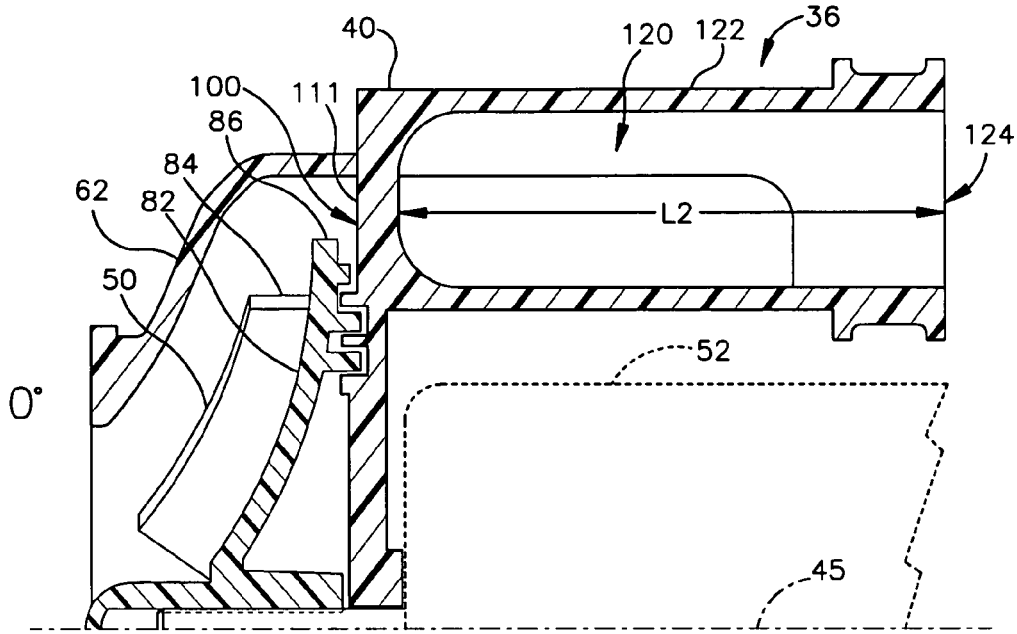
FIGS. 6-9 are sectional views of the rear section taken respectively at lines 6-6, 7-7, 8-8 and 9-9 of FIG. 5.
Figure 7:
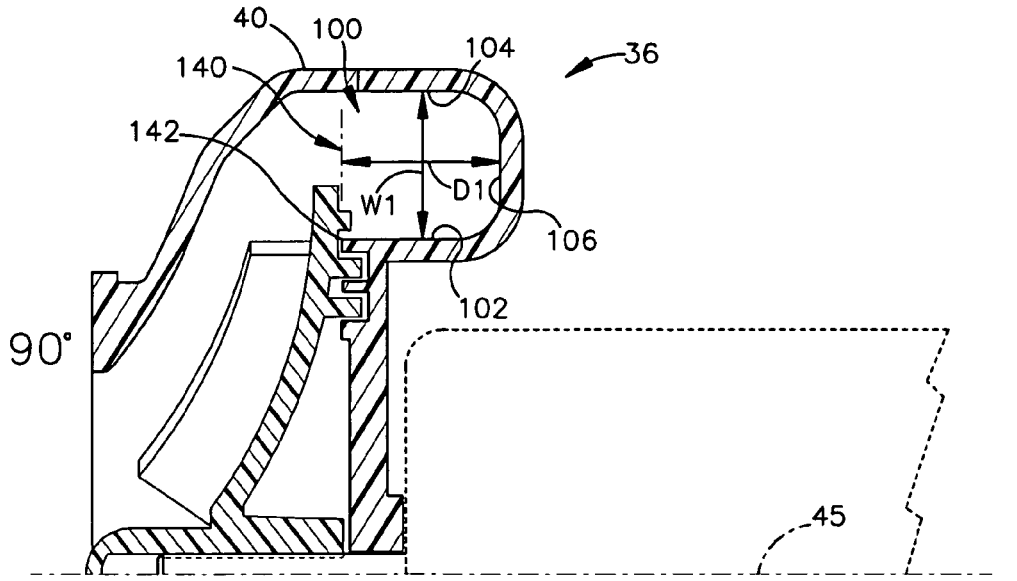
Figure 8:
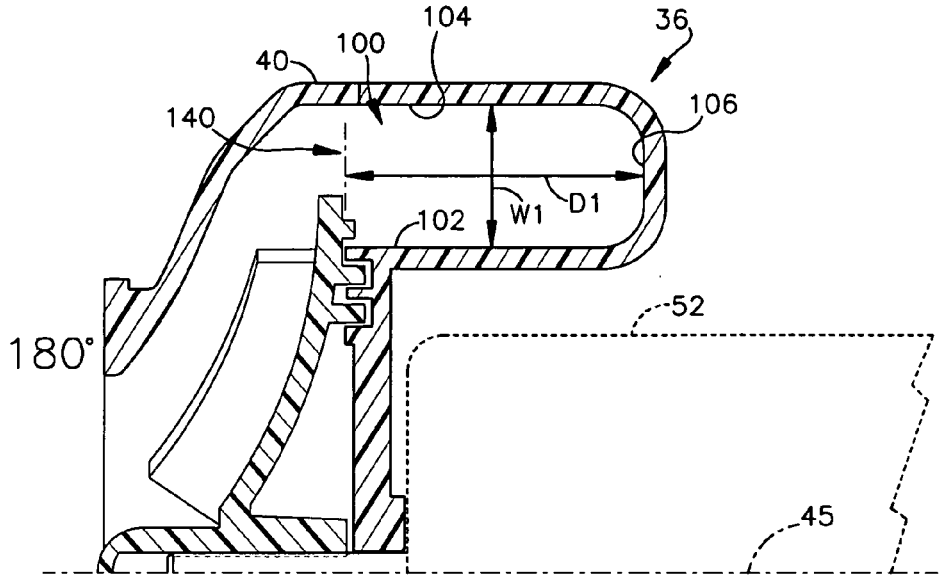
Figure 9:
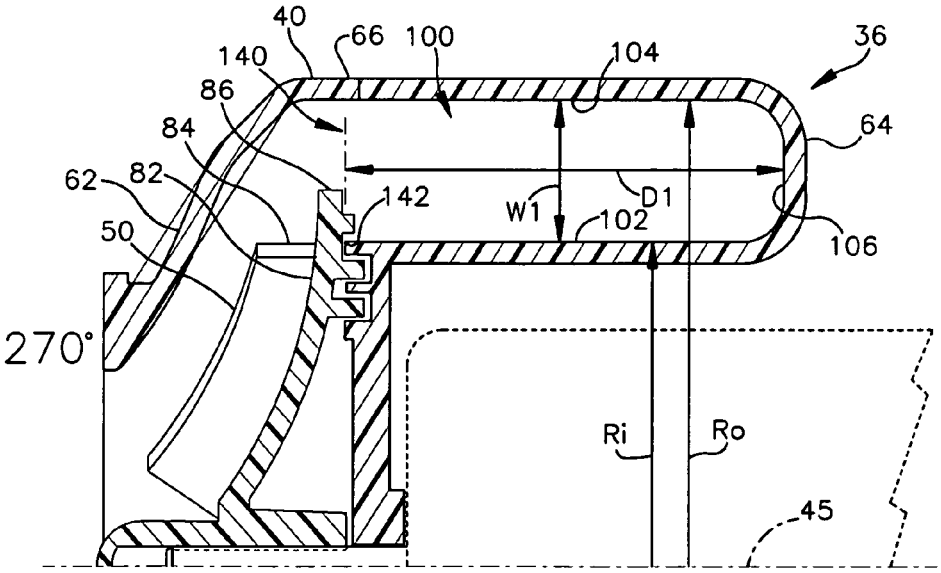

In FIG. 5, locations in the channel 100 at 0°, 90°, 180° and 270° from the first end 111 of the channel 100 are labeled. The 0° and 180° locations are diametrically opposite each other, as are the 90° and 270° locations. Cross-sections of the channel 100 at 0°, 90°, 180° and 270° are shown in FIGS. 6-9, respectively. In FIG. 6, the channel 100 has no depth at its front edge 111 and is thus imperceptible in cross-section. In FIGS. 7-9, the cross-section of the channel 100 is shown to be U-shaped. A front opening 140 of the channel 100 is delineated by a broken line extending directly radially outward from a front edge 142 of the radially inner surface 102. The channel 100 has a width W1 extending from the radially inner surface 102 to the radially outer surface 104 and a depth D1 extending from the front opening 140 to the rear surface 106. The width W1 is shown at mid depth, or center of the depth of the channel 100. Similarly, the depth D1 is shown at mid width, or center of the width of the channel 100, where the depth D1 is greatest.

The following paragraphs describe a combination of features relating to the shapes of the collection and outlet channels 100 and 120 (FIG. 6). These features provide efficient fan performance with minimized diametric size of the fan housing 40, by facilitating uniformly rearward air movement while minimizing radial widening of the air path.

The first feature relates to the shapes of the axially-extending radially inner and outer surfaces 102 and 104. At locations 90°, 180° and 270° respectively, the cross-sectional profiles of the radially inner and outer surfaces 102 and 104 extend linearly and directly rearward along a distance of more 50%, 65% and 80% of the channel depth D1, and preferably more than 65%, 80% and 90% of the channel depth D1.

The following features relate to the variation of the channel depth D1 with respect to the channel width W1: At 90°, 180° and 270° respectively, the channel depth D1 is greater than 0.5 times, 1.0 times, and 1.5 times the width W1, and preferably greater than 1.0 times, 2.0 times, and 2.6 times the channel width W1.

Over a 90 degree range, such as from 90° to 180° or from 180° to 270°, an increase in channel depth D1, measured in units of distance such as mm, is over twice, preferably over five times, and more preferably over ten times the increase in channel width W1. These criteria are met for any positive value of increase of D1 if W1 is uniform or decreasing along the 90 degree range.

The following features relate to variation of the channel width W1 with respect to circumferential position about the channel 100: As shown in FIG. 5, the radially inner surface 102 is centered on the axis 45, with an inner radius Ri that is uniform about the axis 45, thus rendering the distance between the channel 100 and the axis 45 uniform about the axis 45. The inner radius Ri is smaller than the radius Rp of the backplate periphery 86 of the impeller 50. In contrast, an outer radius Ro of the radially outer surface 104 is greater than the radius Rp of the backplate periphery. The outer radius Ro, and thus also the channel width W1, increases slightly along the circumferential length of the channel 100. Specifically, over a 90 degree range, such as from 90° to 180° or from 180° to 270°, the width W1 increases by less than 30% and preferably by less than 10%.

Figure 10:
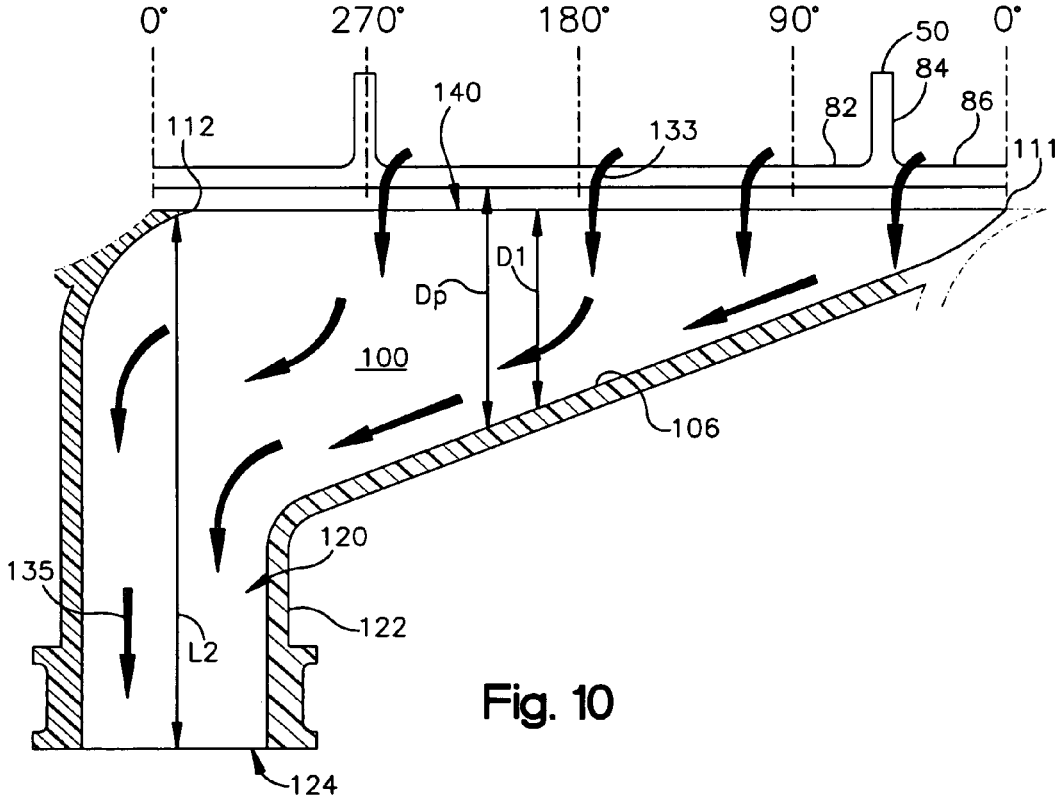
FIG. 10 is a sectional view taken at circumferentially extending line 10-10 of FIG. 5.

The following features relate to variation of the channel depth D1 with respect to circumferential position about the channel 100: As shown in FIG. 10, the circular front opening 140 of the channel 100 is centered on the axis 45 (FIG. 3). In contrast, the rear surface 106 falls away rearwardly approximately linearly with circumferential distance from the first end 111. The channel depth D1, and thus also an axial distance Dp of the rear surface 106 from the backplate periphery 86, increases approximately linearly with circumferential distance over a 90 degree section such as from 90° to 180° or from 180° to 270°.

As shown in FIG. 6, the outlet channel 120 has a length L2. It further has a rectangular cross-sectional profile shown in FIG. 5, with a radially extending height H2 and a laterally extending width W2. The width W2 is smaller than the length L2 (FIG. 6) and greater than the height H2.

The outlet channel 100 is relatively close to the axis 45. A radially innermost location 161 in the outlet channel 120, and thus the outlet channel 120 itself, is closer to the axis 45 than is the radially outer periphery 86 of the impeller backplate 82. Furthermore, the radially innermost location 161 in the outlet channel 120, and thus the outlet channel 120 itself, is closer to the axis 45 than are radially innermost and outermost locations 163 and 165 of the radially outer surface 104, respectively located at the first and second ends 111 and 112 of the channel 100.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A fan comprising:

a fan housing located on an axis, and having axially front and rear sections that together define a chamber;

an inlet in the front section through which air can enter the chamber;

an impeller in the chamber configured to rotate about the axis to drive the air radially outward; and a trough-shaped channel in the rear section, extending circumferentially about the axis from a first end of the channel to a second end of the channel, configured to channel the air away from the first end circumferentially toward the second end;

the channel having a radially extending width and an axially extending depth, the depth increasing from the first end toward the second end such that, over a 90° range, an increase in the depth is greater than twice an increase in the width.

2. The fan of claim 1 wherein the channel width increases over the 90° range.

3. The fan of claim 1 wherein the 90° range extends from a first location in the channel located 90° from the first end, to a second location in the channel located 180° from first end.

4. The fan of claim 1 wherein, at a location in the channel diametrically opposite the first end, the channel depth is greater than the channel width.

5. The fan of claim 1 wherein the rear housing section has a surface bordering the channel that extends, at a location in the channel diametrically opposite the first end, linearly rearward along a distance of greater than 65% of the channel depth.

6. The fan of claim 1 wherein the channel depth increases approximately linearly with circumferential distance over the 90° range.

7. The fan of claim 1 wherein the channel width increases by less than 30% over the 90° range.

8. A fan comprising:

a fan housing located on an axis, and having axially front and rear sections that together define a chamber;

an inlet in the front section through which air can enter the chamber;

an impeller in the chamber configured to rotate about the axis to drive the air radially outward; and a trough-shaped channel in the rear section, extending circumferentially about the axis from a first end of the channel to a second end of the channel, configured to channel the air away from the first end circumferentially toward the second end and having, at a reference location in the channel diametrically opposite the first end, a depth greater than the width of the channel.

9. The fan of claim 8 wherein at another reference location, 270° from the first end toward the second end, the channel depth is greater than 1.5 times the channel width.

10. A fan comprising:

a fan housing located on an axis, and having axially front and rear sections that together define a chamber;

an inlet in the front section through which air can enter the chamber;

an impeller in the chamber configured to rotate about the axis to drive the air radially outward; and a trough-shaped channel in the rear section, extending circumferentially about the axis from a first end of the channel to a second end of the channel, configured to channel the air away from the first end circumferentially toward the second end, in which, at a reference location in the channel diametrically opposite the first end, a surface of the rear housing section, bordering the channel, extends linearly rearward along a distance of greater than 65% of the channel depth.

11. The fan of claim 10 wherein at another reference location, 270° from the first end, the surface extends linearly rearward along a distance of greater than 80% of the depth of the channel.

12. A fan comprising:

a fan housing located on an axis, and having axially front and rear sections that together define a chamber;

an inlet in the front section through which air can enter the chamber;

an impeller in the chamber configured to rotate about the axis to drive the air entering the chamber radially outward; and a trough-shaped channel in the rear section, extending circumferentially about the axis from a first end of the channel to a second end of the channel, configured to channel the air away from the first end circumferentially toward the second end, and having a width that increases by less than 10% over a 90° range along the channel extending from a location 90° from the first end to a location 180° from the first end.

13. The fan of claim 12 wherein the distance between the channel and axis is uniform about the axis.

14. A fan comprising:

a fan housing located on an axis, and having axially front and rear sections that together define a chamber;

an inlet in the front section through which air can enter the chamber;

an impeller in the chamber configured to rotate about the axis to drive the air entering the chamber radially outward; and a trough-shaped channel in the rear section, extending circumferentially about the axis from a first end of the channel to a second end of the channel, configured to channel the air away from the first end circumferentially to the second end; and an outlet channel extending rearward from the second end to redirect the air to flow axially away from the collection channel;

wherein the impeller includes a backplate with a radially outer periphery and blades extending forward from the backplate, and the outlet channel is closer to the axis than is the periphery of the backplate.

15. A fan comprising:

a fan housing located on an axis, and having axially front and rear sections that together define a chamber;

an inlet in the front section through which air can enter the chamber;

an impeller in the chamber configured to rotate about the axis to drive the air entering the chamber radially outward; and a trough-shaped channel in the rear section, extending circumferentially about the axis from a first end of the channel to a second end of the channel, configured to channel the air away from the first end circumferentially to the second end; and an outlet channel extending rearward from the second end to redirect the air to flow axially away from the collection channel;

wherein the outlet channel has a laterally extending width that is smaller than its axially extending length.

16. A fan comprising:

a fan housing located on an axis, and having axially front and rear sections that together define a chamber;

an inlet in the front section through which air can enter the chamber;

an impeller in the chamber configured to rotate about the axis to drive the air entering the chamber radially outward; and a trough-shaped channel in the rear section, extending circumferentially about the axis from a first end of the channel to a second end of the channel, configured to channel the air away from the first end circumferentially to the second end; and an outlet channel extending rearward from the second end to redirect the air to flow axially away from the collection channel;

wherein the outlet channel has a laterally extending width that is greater than its radially extending height.

17. A fan comprising:

a fan housing located on an axis, and having axially front and rear sections that together define a chamber;

an inlet in the front section through which air can enter the chamber;

an impeller in the chamber configured to rotate about the axis to drive the air entering the chamber radially outward; and a trough-shaped channel in the rear section, extending circumferentially about the axis from a first end of the channel to a second end of the channel, configured to channel the air away from the first end circumferentially to the second end; and an outlet channel extending rearward from the second end to redirect the air to flow axially away from the collection channel;

wherein the outlet channel is defined by an outlet tube that is part of the fan housing and rigidly fixed with respect to the front and rear housing sections.

* * * * *